United States Patent [19]

Moll et al.

[11] Patent Number: 4,992,362

[45] Date of Patent: Feb. 12, 1991

[54] PRODUCTION OF A SILVER HALIDE EMULSION

[75] Inventors: Franz Moll, Leverkusen; Bruno Mücke, Bergisch Gladbach; Klaus Wagner, Leverkusen; Herbert Gareis; Wolfgang Graesser, both of Eberbach; Peter Koepff, Heidelberg, all of Fed. Rep. of Germany

[73] Assignee: AGFA Gevaert Aktiengesellschaft, Leverkusen, Fed. Rep. of Germany

[21] Appl. No.: 389,544

[22] Filed: Aug. 4, 1989

[30] Foreign Application Priority Data

Aug. 20, 1988 [DE] Fed. Rep. of Germany ..... 3828312

[51] Int. Cl.[5] ..... G03C 1/02

[52] U.S. Cl. ..... 430/640; 430/567; 430/569; 430/605

[58] Field of Search ..... 430/367, 369, 605, 640

[56] References Cited

U.S. PATENT DOCUMENTS 3,888,676 6/1975 Evans ..... 430/606
4,131,467 12/1978 Bigelow ..... 430/614
4,496,652 1/1985 Haugh et al. ..... 430/605

FOREIGN PATENT DOCUMENTS 0227444 7/1987 European Pat. Off. .
0228256 7/1987 European Pat. Off. .
0231430 12/1985 Fed. Rep. of Germany ..... 430/605

*Primary Examiner*—Hoa Van Le
*Attorney, Agent, or Firm*—Connolly and Hutz

[57] ABSTRACT

The production of a photosensitive silver halide emulsion by precipitation of the silver halide in the presence of gelatine, flocculation and washing of the silver halide precipitated in the presence of the gelatine and redispersion with addition of more gelatine, precipitation being carried out in the presence of a gelatine having a gold number of at most 10 μmol/g gelatine and a cysteine content of at most 6 ppm and redispersion being carried out with a gelatine having a gold number of at least 23 μmol/g gelatine, leads to an emulsion of uniform grain distribution in which undesirably high fogging is avoided.

6 Claims, 3 Drawing Sheets

PRODUCTION OF A SILVER HALIDE EMULSION

INTRODUCTION

This invention relates to a process for the production of a photosensitive silver halide emulsion by precipitation of the silver halide in the presence of gelatine, flocculation and washing of the silver halide precipitated in the presence of the gelatine and redispersion with addition of more gelatine.

BACKGROUND OF THE INVENTION

The oxidation of gelatines to destroy photographically active substances, i.e. to make them inert, and to remove bacterial impurities or to lighten the color of the gelatine is known, hydrogen peroxide, per acids, such as performic acid, peracetic acid, per iodic acid, chloramine T (N-chloro-p-toluenesulfonic acid amide sodium) and the like being used as oxidizing agents.

It is known from EP-A-0 227 444 and EP-A-0 228 256 that it is of advantage to use oxidized gelatine for the production of tabular grain silver halide emulsions, particularly where the emulsion has a high chloride content. However, gelatines of this type have the disadvantage that they lead to an unacceptable increase in fogging.

SUMMARY OF THE INVENTION

Accordingly, the object of the present invention is to modify the production of a silver halide emulsion in such a way that, on the one hand, improved grain growth is obtained and, on the other hand, undesirably high fogging is avoided.

It has now been found that this object can be achieved if, in the process described at the beginning, the precipitation step is carried out in the presence of a gelatine having a gold number of at most 10 μmol/g gelatine and a cysteine content of at most 6 ppm and the redispersion step is carried out with a gelatine having a gold number of at least 23 μmol/g gelatine. The gelatine used for redispersion may have cysteine contents of from 6 to 16 ppm.

Gelatines having a gold number of at least 23 μmol/g are obtained in standard alkaline or acidic treatment. Gelatines having a gold number of at most 10 μmol/g and a cysteine content of at most 6 ppm are obtained from the standard gelatines by oxidation with the oxidizing agents mentioned above.

The gelatine-to-silver ratio by weight (Ge-Si) of the final emulsion is preferably from 1:1 to 1:5, silver being included in the calculation as silver nitrate.

The ratio by weight of the quantity of gelatine added during precipitation to the quantity of gelatine added during redispersion is in particular from 1:1 to 1:10 and preferably from 1:1 to 1:5.

The oxidized gelatine may have been subjected to acidic or alkaline digestion. The raw material may be bone or hide. However, bone is preferred as the raw material because inert gelatines, i.e. gelatines containing only small quantities of photographically active impurities, such as thiosulfate or sulfite, are easier to produce from bone.

Oxidation of the gelatine may be carried out at any stage during its production. Oxidation may also be carried out in the gelatine solution before precipitation of the emulsion begins.

The pH value during oxidation may vary within wide limits and is preferably between pH 2 and pH 8. Although higher and lower pH values are possible, the physical properties of the gelatine are adversely affected in that case.

Oxidation of the gelatine may be monitored by determination of the gold number or the cysteine content and may be terminated in accordance with the desired values.

To determine the gold number, the gelatine is subjected to potentiometric titration with tetrachloroauric acid at pH 2. The gold consumption gives the gold number. Non-oxidized gelatines show gold numbers of ≧23 μmol/g by this method, substantially corresponding to a methionine content of ≧50 μmol/g.

The cysteine content of the gelatine is determined by the process similar to that described by H. Meichelbeck, A. G. Hack and Chr. Sentler in Z. Ges. Textilindustrie 70, 242 (1968). In this process, 1 g gelatine is hydrolyzed for 60 minutes in a boiling water bath with addition of 1 ml water and 1 ml 30% by weight $H_2SO_4$ and, after cooling, is adjusted to pH 7.4 with 3 m tris-(hydroxymethyl)-aminomethane (TRIS) and a TRIS/HCl buffer.

5,5'-Dithio-bis-(2-nitrobenzoic acid) (DTNB) is used as the color reagent. The measurement is carried out at 412 nm. The comparison solution used is the same as as the measuring solution, but without the hydrolyzate. However, since the gelatine hydrolyzates show different colorations which absorb in the above-mentioned range, the hydrolyzate also has to be measured with all additives except DTNB and subtracted from the extinction of the measuring solution.

The buffer is prepared as follows: 121 g TRIS are dissolved in 500 ml water and the pH value adjusted to 7.4 with HCl. The solution is then made up to 1000 ml. Reagent solution: 10 ml TRIS/HCl buffer are diluted with water to approximately 50 ml and 25 mg reagent (DTNB) and 20 mg EDTA salt dissolved therein. The pH value is adjusted to 4 with HCl. The solution is made up to 100 ml.

To adjust the pH value of the gelatine hydrolyzate, 3 m TRIS is additionally required.

To obtain exact values, double determination is essential. The range of variation of the measurements should be no greater than ±1 ppm.

The cysteine content is derived from the measured value using a calibration curve prepared beforehand. As stated in H. Meichelbeck et al, loc. cit., the cysteine content may also be obtained by calculation from the measured value without a calibration curve.

Determination of the gold number and also cysteine analysis can both be excellently reproduced.

The gelatines may or may not be desalted. Preference is attributed to inert gelatines which are characterized in that they contain very few photographically active compounds. Inert gelatines which have not been freed from salts oftern show a high content of Ca ions.

The silver halide present as photosensitive constituent in the photographic emulsion may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Silver bromide iodide emulsions are normally used in the case of color negative and color reversal films while silver chloride bromide emulsions are normally used in the case of color negative and color reversal paper. The silver halide may consist of predominantly compact crystals which may have, for example, a regular cubic or octahedral form or transitional forms. However, the silver halide may also consist with advantage of tabular crystals of which the average diameter-to-thickness ratio is preferably at least 5:1, the diameter of a crystal being defined as the diameter of a circle with an area corresponding to the projected area of the crystal. However, the layers may also contain tabular silver halide crystals in which the diameter-to-thickness ratio is considerably greater than 5:1, for example from 12:1 to 30:1.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 μm and 5.0 μm, more preferably between 0.2 μm to 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The above noted invention will become more clearly explained when taken in view of the following description together with the accompanying drawings.

DETAILED DESCRIPTION

Figure 1:
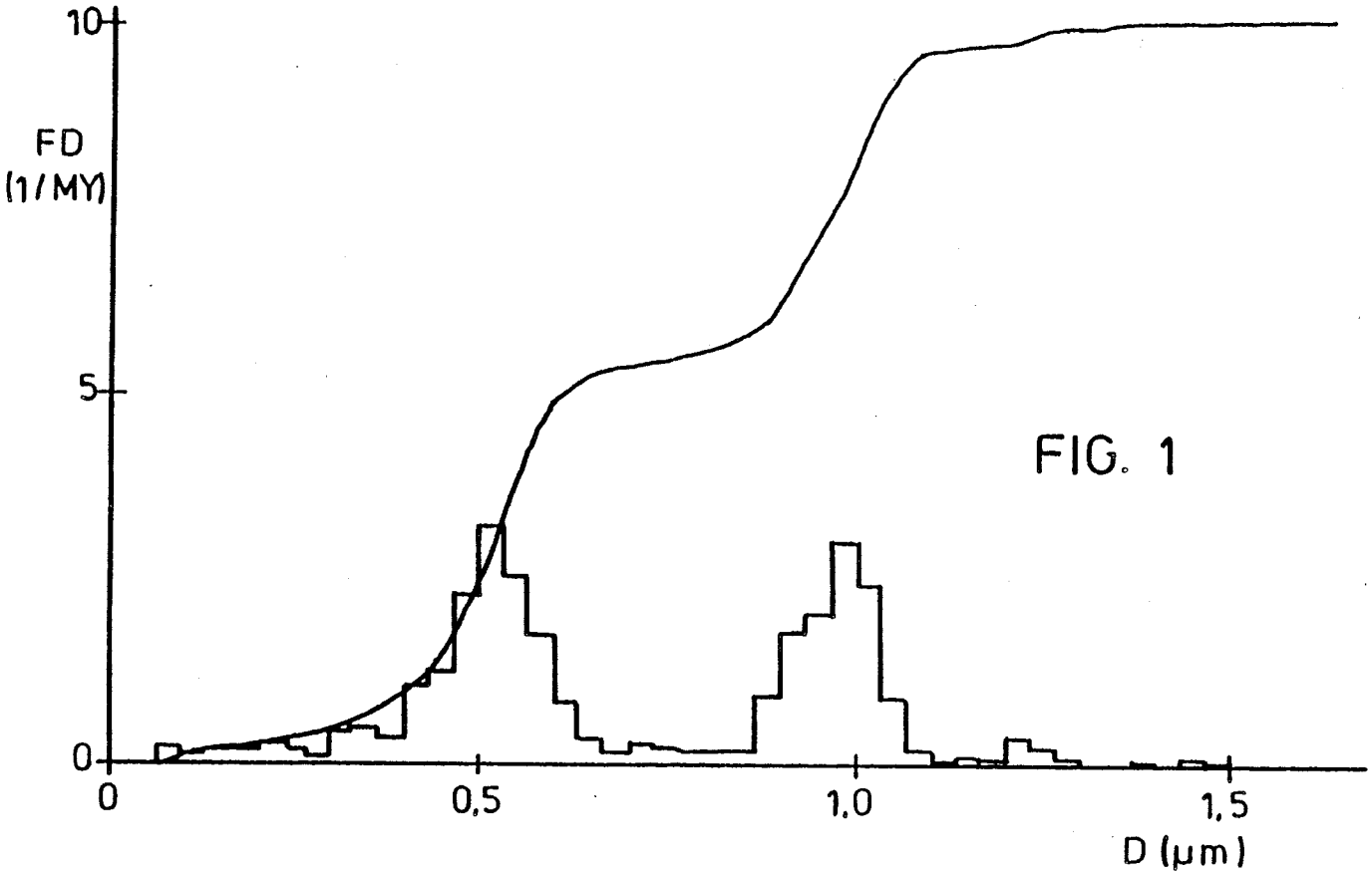
FIG. 1 is a graph showing the grain distribution of Emulsion A of example 1.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Zelikman et al, Making and Coating Photographic Emulsion, The Focal Press, London (1966)).

Precipitation of the silver halide may be carried out in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which new nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Ir, Rh, Fe, may be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion by flocculation and washing.

The silver halide emulsion is generally subjected to chemical sensitization under defined conditions (pH, pAg, temperature, gelatine, silver halide and stabilizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or noble metal compounds (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seg and Research Disclosure No. 17643, Section III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type are azaindenes, preferably tetra- and pentaazindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, (substituted) benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure No. 17643 (1978), Section VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643/1978, Section IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathiaor selenocarbocyanines and 9-ethyl naphthothiaoxa- and benzimidazocarbocyanines, providing the dye contains at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

In addition to the gelatines according to the invention, the emulsions may contain additional binders, such as synthetic or natural, layer-forming polymers.

The emulsions according to the invention are suitable for all types of photographic materials, such as X-ray film, black-and-white film, black-and-white paper, but especially for color photographic materials.

Examples of color photographic materials are color negative films, color reversal films, color positive films, color photographic paper, dye-sensitive materials for the dye diffusion transfer process or the silver dye bleaching process.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The color photographic materials normally contain at least one red-sensitive emulsion layer, at least one green-sensitive emulsion layer and at least one blue-sensitive emulsion layer and, optionally, intermediate layers and protective layers.

Apart from binder and silver halide grains, color couplers are essential constituents of the photographic emulsion layers.

Non-diffusing monomeric or polymeric color couplers are associated with the differently sensitized emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type.

Color couplers for producing the magenta component dye image are generally couplers of the 5-pyrazolone type, the indazolone type or the pyrazoloazole type.

Color couplers for producing the yellow component dye image are generally couplers containing an open-chain ketomethylene group, more especially couplers of the α-acyl acetamide type, of which suitable examples are α-benzoyl acetanilide couplers and α-pivaloyl acetanilide couplers.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

DIR couplers containing development inhibitors of the azole type, for example triazoles and benzotriazoles, are described in DE-A-24 14 006, 26 10 546, 26 59 417, 27 54 281, 27 26 180, 36 26 219, 36 30 564, 36 36 824, 36 44 416 and 28 42 063. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A-157 146 and 204 175, in U.S. Pat. Nos. 4,146,396 and 4,438,393 and in GB-A-2,072,363.

DIR couplers releasing a development inhibitor which is decomposed in the developer bath to photographically substantially inactive products are described, for example, in DE-A-3 209 486 and in EP-A-167 168 and 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-115 304, 167 173, GB-A-2,165,058, DE-A-37 00 419 and U.S. Pat. No. 4,707,436.

In a multilayer photographic material, the DIR couplers may be added to various layers, including for example even non-photosensitive layers or intermediate layers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-89 834, 110 511, 118 087, 147 765 and in U.S. Pat. Nos. 4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group, so that coupling products which are diffusible or which at least show slight or limited mobility are obtained in the reaction with color developer oxidation products (U.S. Pat. No. 4,420,556).

The material may also contain compounds different from couplers which may release, for example, a development inhibitor, a development accelerator, a bleach accelerator, a developer, a silver halide solvent, a fogging agent or an anti-fogging agent, for example so-called DIR hydroquinones and other compounds of the type described, for example, in U.S. Pat. Nos. 4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-O-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecyl-benzene and diisopropyl naphthalene.

Each of the differently sensitized photosensitive layers may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive intermediate layers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (Dec. 1978), Chapter VII, 17 842/1979, pages 94–97 and 18 716/1979, page 650 and in EP-A-69 070, 98 072, 124 877, 125 522 and in U.S. Pat. No. 463,226.

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styrene dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (Dec. 1978), Chapter V, in U.S. Pat. Nos. 2,632,701 and 3,269,840 and in GB-A-852,075 and 1,319,763.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, Dec. 1978, Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) preventing the impairment (deterioration or degradation) of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment (deterioration or degradation) of magenta-red dye images, particularly their impairment (deterioration or degradation) as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. Nos. 3,288,775, 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. Pat. Nos. 3,635,718, 3,232,763 and GB-A-994,869); N-hydroxymethyl phthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611); acid derivatives (U.S. Pat. Nos. 2,725,294 and 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. Nos. 3,321,313 and 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A-0 114 699).

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraactic acid, diethylenetriamine pentaacetic acid, nitrilotriacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers. Development is followed by a diffuse second exposure and then by development with a color developer, bleaching and fixing.

The following alkali-limed bone gelatines were used for the Examples:

| | Gold number [μmol/g] | Cysteine content [ppm] | Viscosity [mPa.s] of the 10% by weight solution at 40% |
|---|---|---|---|
| Gelatine 1 (non-oxidized, non-desalted) | 25 | 12 | 21.5 |
| Gelatine 2 (oxidized, non-desalted) | 5 | 5 | 20.0 |
| Gelatine 3 (non-oxidized, desalted) | 26 | 11 | 21.0 |
| Gelatine 4 (oxidized, desalted) | 4 | 6 | 19.5 |

EXAMPLE 1

Using gelatine 1, a silver bromide chloride emulsion containing 10 mol-% silver chloride was prepared by the double-jet process at 56° C. After precipitation of the silver halide, the GeSi was 0.15. The emulsion was flocculated by addition of a flocculating agent and reduction of the pH value to 3.5 and then washed. The pH value was then readjusted to 4.5, more gelatine 1 was added and the emulsion was redispersed while heating. After redispersion, the GeSi was 0.65. The emulsion was then ripened to optimal sensitivity with addition of thiosulfate (emulsion A).

Another emulsion was prepared in the same way using gelatine 2 during precipitation and redispersion (emulsion B).

Another emulsion was prepared in the same way using gelatine 2 during precipitation and gelatine 1 during redispersion (emulsion C).

The grain size distributions were determined using a Möller counter (G. Möller Int. Congr. Phot. Sci. Moscow 1970, page 125).

The emulsions were provided with 180 mg of a blue sensitizer and 120 g of a yellow coupler per 100 g $AgNO_3$ and coated onto a PE-coated paper support. The emulsion layer was then overcoated with a layer of gelatine containing a hardener. After drying, the layers were exposed in a sensitometer and developed by the EP 2 process.

Determination of the latent image was carried out 6 hours after exposure, the exposed strip being stored at room temperature.

The directly developed materials and the materials developed after storage for 6 hours were compared with one another and produced ΔE latent image [log I.t.].

| Emulsion | Grain evaluation V | Grain evaluation distribution | Sensitometry S | Sensitometry F | Sensitometry Gamma 1 | ΔE latent image log I.t |
|---|---|---|---|---|---|---|
| A | 0.96 | strong new seed formation | 100 | 0.112 | 1.65 | −0.02 |
| B | 0.91 | highly monodisperse | 90 | 0.195 | 1.60 | −0.06 |
| C | 1.01 | highly monodisperse | 120 | 0.115 | 1.68 | −0.03 |

V: Volume weighted mean value in μm of all the silver halide grains measured
S: Relative sensitivity
F: Fogging
Gamma 1: slope of characteristic curve between points 0.1 over fog and 0.85 over fog.

Figure 2:
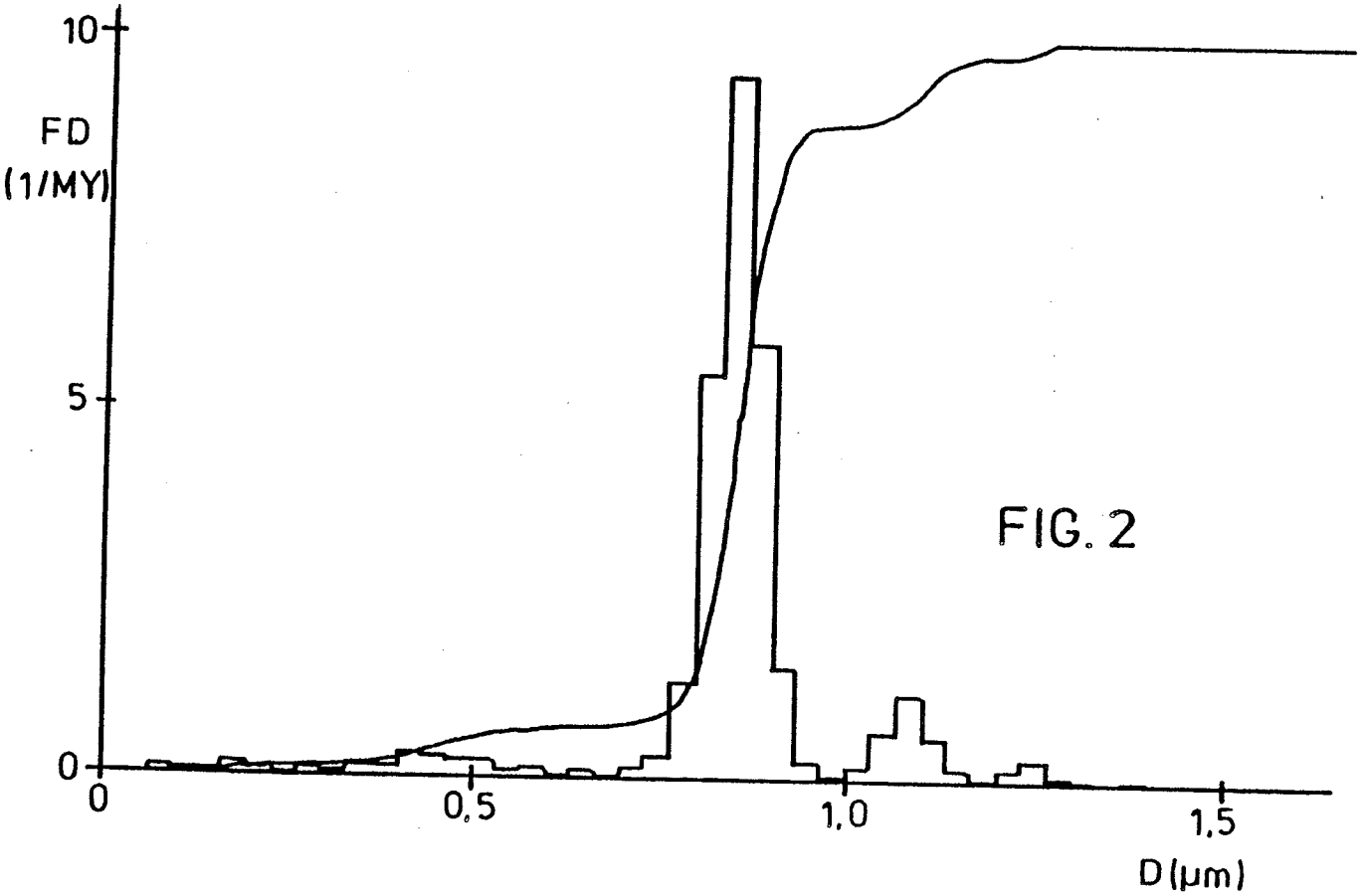
FIG. 2 is a graph showing the grain distribution of Emulsion B of Example 1.
Figure 3:
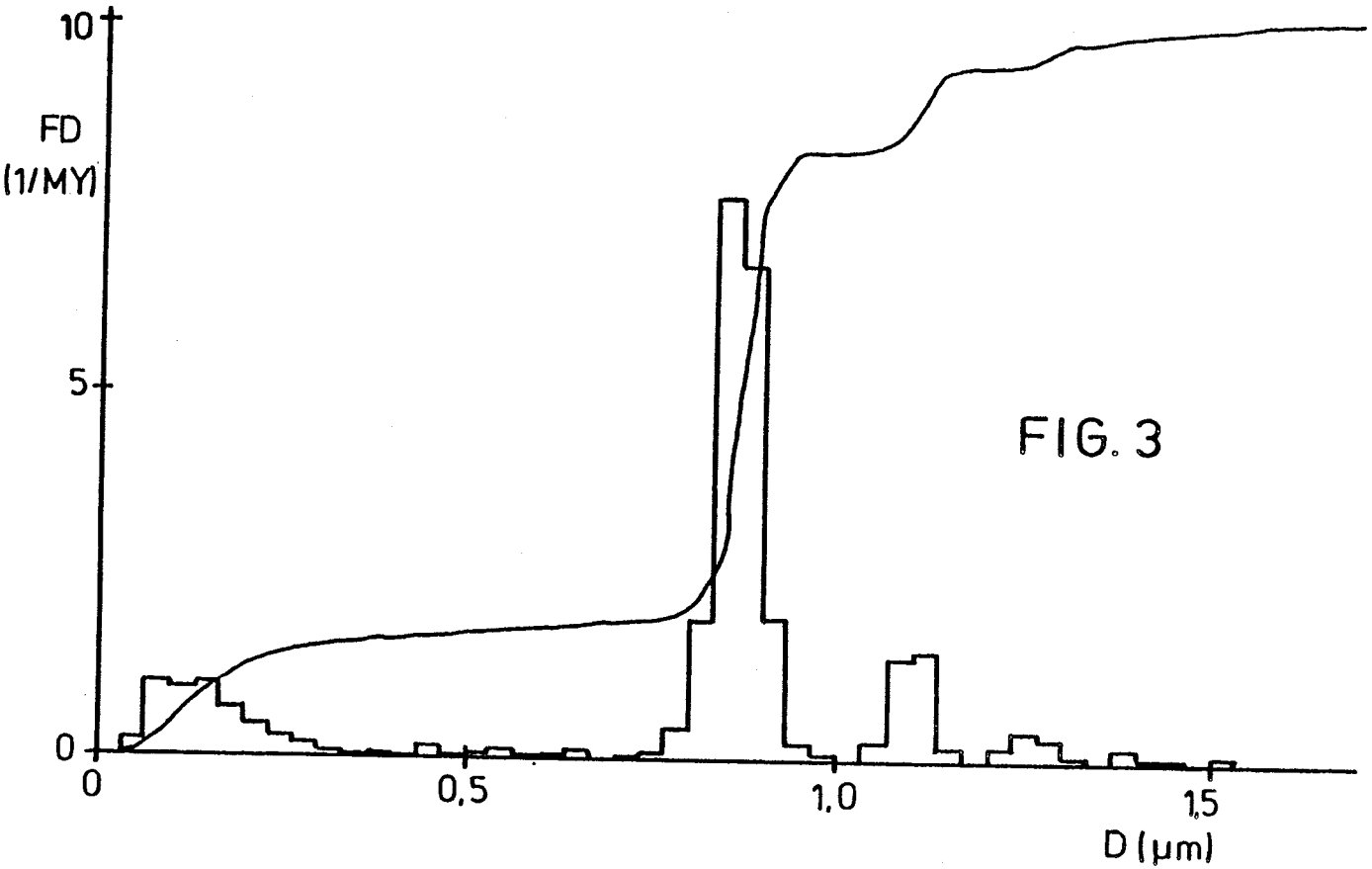
FIG. 3 is a graph showing the grain distribution of Emulsion C of Example 1.

The grain distributions are shown in FIG. 1 (emulsion A), FIG. 2 (B) and FIG. 3 (C).

The graphs of FIGS. 1, 2 and 3 show the interrelation of the grain size distribution in the emulsions A, B and C with the frequency distribution of the grains. In FIGS. 1, 2 and 3 the abscissa gives the numerical grain size distribution expressed as diameter D of the globe of same volume as the grain in μm.

The ordinate gives the frequency distribution of the grains in 1/μm.

In each of the FIGS. 1, 2 and 3 a characteristic curve is shown. This curve is the summing-up over all grains from 0 to 100%.

The Examples show that the use of oxidized gelatine in the mixture produces an improved grain distribution, i.e. highly monodisperse emulsions. However, where oxidized gelatine is used in the subsequent ripening, higher fogging is obtained. In addition, the regression of the latent image is considerably greater. If, by contrast, non-oxidized gelatine is used in the subsequent ripening, better fogging and a more stable latent image are obtained for the same good grain distribution.

EXAMPLE 2

Example 1 was repeated using gelatine 3 instead of gelatine 1 and gelatine 4 instead of gelatine 2. The silver chloride bromide emulsion contained 95 mol-% silver chloride; ripening to optimal sensitivity was carried out with addition of gold salts and thiosulfate. All other parameters remained unchanged. Emulsions D (gelatine 3 only), E (gelatine 4 only) and F (gelatine 4 during precipitation, gelatine 3 during redispersion) were obtained.

As in Example 1, the emulsions were provided with a blue sensitizer and a yellow coupler and then coated onto a PE-coated paper support. The emulsion was then overcoated with a layer of gelatine containing a hardener.

The emulsions were tested as in Example 1.

| Emulsion | Grain evaluation V | Grain evaluation distribution | Sensitometry S | Sensitometry F | Sensitometry Gamma 1 | ΔE latent image log I.t |
|---|---|---|---|---|---|---|
| D | 0.41 | new seed formation at 0.25 nm | 100 | 0.103 | 1.80 | −0.06 |
| E | 0.38 | no new seed formation | 75 | 0.201 | 1.60 | −0.21 |
| F | 0.40 | no new seed formation | 110 | 0.110 | 1.85 | −0.08 |

It was also found that, although this salt-free inert bone gelatine provides for improved grain growth through oxidation, it also promotes higher fogging. Where the oxidized gelatine is used only during precipitation and where the non-oxidized gelatine is used during the subsequent ripening, good grain growth is obtained for good fogging and good latent image stability.

We claim:

1. A process for the production of a photosensitive silver halide emulsion by precipitation of the silver halide in the presence of gelatine, flocculation and washing of the silver halide precipitated in the presence of the gelatine and redispersion with addition of more gelatine, characterized in that precipitation is carried out in the presence of a gelatine having a gold number of at most 10 μmol/g gelatine and a cysteine content of at most 6 ppm while redispersion is carried out with a gelatine having a gold number of at least 23 μmol/g gelatine.

2. A process as claimed in claim 1, characterized in that the gelatine for redispersion has a cysteine content of 6 to 16 ppm.

3. A process as claimed in claim 1, characterized in that the ratio by weight of gelatine to silver in the final emulsion is from 1:1 to 1:5, silver being included in the calculation as silver nitrate.

4. A process as claimed in claim 1, characterized in that the ratio by weight of the quantity of gelatine used during precipitation to the quantity of gelatine used during redispersion is from 1:1 to 1:10.

5. A photographic silver halide recording material, characterized in that it contains at least one silver halide emulsion layer comprising a silver halide emulsion produced by the process claimed in claims 1, 2, 3 or 4.

6. A photographic silver halide recording material, characterized in that all the photosensitive silver halide emulsion layers comprise silver halide emulsions produced by the process claimed in claims 1, 2, 3 or 4.

* * * * *